United States Patent [19]

White et al.

[11] 4,412,815

[45] Nov. 1, 1983

[54] LOADING SYSTEM FOR AN ANNEALING FURNACE CHARGE AND COMPONENTS THEREFOR

[75] Inventors: James H. White, Manotick; Bernard C. Stonehill, Mississauga; Brian F. Johnston, Hamilton; Albert R. Perrin, Mississauga; Roderick I. L. Guthrie, Westmount, all of Canada

[73] Assignee: Dofasco Inc., Hamilton, Canada

[21] Appl. No.: 316,182

[22] Filed: Oct. 29, 1981

[51] Int. Cl.[3] ..... F27B 11/00; C21D 9/00; C21D 1/06

[52] U.S. Cl. ..... 432/206; 266/256; 432/260

[58] Field of Search ..... 432/203, 206, 260; 266/256

[56] References Cited

U.S. PATENT DOCUMENTS

| | | | |
|---|---|---|---|
| 3,149,827 | 9/1964 | Whitten | 266/256 |
| 3,373,983 | 3/1968 | Johnson et al. | 432/260 |
| 3,386,721 | 6/1968 | Jones et al. | 432/260 |
| 3,586,303 | 6/1971 | Corbett, Jr. | 432/260 |
| 3,716,223 | 2/1973 | Corbett, Jr. | 432/260 |
| 3,782,894 | 1/1974 | Blackman | 432/260 |
| 4,287,920 | 9/1981 | Corbett, Jr. | 432/260 |

FOREIGN PATENT DOCUMENTS

| | | | |
|---|---|---|---|
| 44-29565 | 2/1969 | Japan | 432/206 |

*Primary Examiner*—John J. Camby

*Attorney, Agent, or Firm*—Hirons, Rogers & Scott

[57] ABSTRACT

The invention provides a loading system for the charge of an annealing furnace of the kind intended for the treatment of a stack of coils mounted one on top of the other with their central cores in register with one another, a protective heat exchange gas atmosphere being circulated around the stack within a cylindrical bell-shaped muffle cover to heat and subsequently cool the charge. The system comprises a diffuser member having a gas impeller at its center that receives gas passing downwards through the coil cores and discharges it radially into the annular space between the stack and the muffle cover in a preferred helical path. The stack rests on a load member placed on the diffuser member, a convector plate is interposed between each pair of superimposed coils and the stack is completed by a top member and a plug member. Each of the load members, the convector plate and the top member has a plurality of radially extending gas flow passages that permit the gas to pass from the annular space to the coil centers in heat exchange contact with the respective ends of the coils. Thus even distribution of the gas and consequent rapid even heating of the coils is obtained, the flow plug also augmenting a helical downward gas flow in the registering coil cores to the impeller.

7 Claims, 7 Drawing Figures

LOADING SYSTEM FOR AN ANNEALING FURNACE CHARGE AND COMPONENTS THEREFOR

FIELD OF THE INVENTION

The present invention is concerned with improvements in or relating to annealing furnaces, more particularly to loading systems for the charge of such furnaces, and in or relating to components for such furnaces.

REVIEW OF THE PRIOR ART

One of the final steps in the production of coils of metal products such as sheet steel is to anneal the coils in a furnace under carefully controlled conditions of time, temperature and atmosphere. Sheet steel coils typically are of diameter 90–180 cm (36–72 in.) and weighs up to about 20,000 kg (45,000 lbs). A typical annealing furnace is about 4.5 meters (15 ft) high and 2.4 meters (8 ft) diameter and can accept up to four such coils stacked one on top of the other. Gas of controlled composition is fed into the furnace and serves as the convective heat exchange medium for transmitting heat to the coils, the gas typically being heated to about 760° C. (1400° F.) and circulated continuously therein until all of the metal of the coils has reached the required annealing temperature and has been held at that temperature for the required minimum time; the furnace contents are then cooled, again using the gas as the convective heat exchange medium, until the coils can be handled for removal. In a typical annealing cycle the heating period may take from about 16 to about 30 hours, or until the furnace charge has reached a temperature of about 700° C. (1075° F.–1300° F.); a holding period may not be necessary or may occupy up to another 30 hours for certain grades of steel; the cooling period is usually longer in duration than the heating period and the total cycle may occupy from about 60 to about 100 hours.

It will be apparent that an objective of any annealing furnace system is to heat all of the metal of the coils as quickly as possible, but also as uniformly as possible, so that all of the metal is properly annealed, and for this purpose heat should be applied to the coil ends as well as to their circumferences.

Annealing processes inherently involve a substantial consumption of energy, which could be reduced by more efficient transfer of heat between the circulating gas in the inner muffle and the coils. The consequent reduction in process time would also increase the output of the installation.

In a known annealing furnace construction, for example that described and illustrated in U.S. patent Ser. No. 2,998,236, issued Aug. 29, 1961 to Hans Cramer et al, from two to four coils are stacked one on top of the other with their central axial openings (usually called the coil "eyes") aligned. A downwardly-opening metal bell-shaped inner muffle fits closely around the coils and contains the heat exchange gaseous atmosphere, while a heavily-insulated downwardly-opening bell-shaped outer casing encloses the inner casing and a plurality of heaters, usually gas-fired radiant heaters. The lowest coil is seated on a so-called diffuser member having at its centre a motor-driven fan for circulating the furnace atmosphere, the coil being seated on this diffuser member with its eye aligned over the fan inlet so that the latter can draw the gas down through the eye and then discharge it radially for circulation along the outside surface of the coil and the heated inside surface of the inner muffle casing. A so-called convector plate is interposed between each immediately adjacent pair of coils, this plate enabling the hot gases to contact the two facing coil ends and then to pass to the coil eyes for return to the fan inlet.

Cramer et al propose that to facilitate the rapid and uniform heating of the coils the diffuser member, the convector plates, guide members disposed within the central aperture of the convector plates, and even the inside surface of the inner muffle, be arranged so that the gaseous atmosphere has a longitudinal or swirling motion, causing it to spiral upwardly between the coils and the inner muffle, move spirally horizontally through the convector plates, and be controlled in its downward flow through the coil eyes to the fan inlet.

It will be apparent from the above description that the operating conditions for the entire furnace, and particularly for the diffuser member and the convector plates, are very severe. The construction of the diffuser member and the convector plates must be such that the hot gases are suitably guided and distributed, and yet they are subjected to heavy loads and adverse conditions while heating and cooling. For example, the coils expand and contract considerably during the cycle, applying large transverse forces to the convector plates. It is not unusual therefore to find that prior art convector plates may have a life of only about six months, early replacement being preferable to the possibility of collapse during the cycle and resultant damage to the coils being processed. The overriding need for components of reasonable cost and life appears to have led to the adoption of diffuser member and convector plate designs that introduce considerable turbulence within the gas flow and do not permit the desirable spiralling flow envisaged by Cramer et al, with consequent pressure losses and process inefficiency.

DEFINITION OF THE INVENTION

It is therefore an object of the invention to provide a new loading system for an annealing furnace that will permit improved circulation of the gaseous atmosphere therein.

It is a more specific object to provide a new diffuser member and also a new convector plate construction for use in an annealing furnace.

In accordance with the present invention there is provided a loading system for the charge of an annealing furnace of the kind employed for the treatment within a cylindrical inner muffle cover of a plurality of hollow-cored coils of metal products stacked in the muffle cover one on top of the other with the hollow cores thereof registered vertically with one another, and their outer cylindrical surfaces spaced from the inner cylindrical surface of the muffle cover to form an annular space between said cylindrical surfaces, the structure comprising:

a lowermost diffuser member adapted for support of the furnace charge, comprising a circular back plate member having at its centre an aperture for the reception of a gas impeller adapted to receive gas flowing axially from the registered hollow cores of the coils and discharge it radially through the diffuser member, the back plate having thereon a plurality of upstanding circumferentially spaced diffuser elements providing between themselves a corresponding plurality of radially-outwardly-extending gas flow passages from its centre to its periphery, the said passages conveying the impelled gas therethrough and discharging it radially and circumferentially into the annular space between the furnace muffle inner wall and the stacked furnace charge to move helically upward therein;

a lower load convector member for mounting on the diffuser member comprising a circular back plate member having thereon a plurality of upstanding, circumferentially-spaced plate members, said plate members receiving the lower end of the lowest coil, and providing between themselves a corresponding plurality of radially extending gas passages conveying impelled gas radially inward from said annular space to the impeller in heat exchange contact with the said coil lower end;

at least one intermediate convector plate member for mounting on the upper end of a coil and for receiving the lower end of a superimposed coil, comprising a plurality of connected circumferentially-spaced wedge-shaped members forming between themselves respective radially-extending gas passages conveying impelled gas radially inward from said annular space to the coil cores in heat exchange contact with the respective upper and lower coil ends;

an upper load convection member for mounting on the upper end of the uppermost coil, comprising a circular back plate member having thereon a plurality of downwardly-extending circumferentially-spaced diffuser elements providing between themselves a corresponding plurality of radially-extending gas passages conveying impelled gas radially inward from said annular space to the core of the uppermost coil in heat exchange contact with the upper end of the uppermost coil; and a flow plug member interposed in the path of the gas flowing from the said annular space into the uppermost coil core through the coil upper end, the flow plug member being mounted on the upper end of the uppermost coil so as to protrude downwards into the coil core and providing an opening to the uppermost coil core within the core restricting the flow of gas into the said uppermost coil core and facilitating the flow of gas through the vertically registered cores to follow a helical path in contact with the innermost turns of the coils.

Also in accordance with the invention there is provided a lowermost diffuser member for use in a loading system for the charge of an annealing furnace of the kind employed for the treatment within a cylindrical inner muffle cover of a plurality of hollow-cored coils of metal products stacked inside the muffle cover one on top of the other with the hollow cores thereof registered vertically with one another, the said diffuser member comprising:

a circular back plate having at its centre an aperture for the reception of a gas impeller adapted to receive gas flowing axially from the said registered hollow cores of the coils and discharge it radially through the diffuser member, the back plate having thereon a plurality of upstanding circumferentially-spaced diffuser elements providing between themselves a corresponding plurality of radially-outwardly extending gas flow passages from its centre to its periphery, the said passages conveying the impelled gas therethrough and discharging it radially and circumferentially into the annular space between the furnace muffle inner wall and the stacked furnace charge to move helically upward therein;

each said diffuser element comprising:

a radially inner diffuser element portion providing respective side wall portions of two adjacent flow path inlets and a sharp vertical forward edge at the radially inner intersection of the two said side wall portions, each radially inner element portion being of height less than the remainder of the respective element so that it is not engaged by the adjacent bottom edge of a coil mounted on the diffuser member;

a support element portion extending over a substantial radius of the diffuser member for engagement with the adjacent bottom edge of a coil mounted on the diffuser member to thereby support the furnace charge thereon and also providing respective side wall portions of the said two adjacent flow paths; and a radially-outer flow guidance element portion providing respective side wall portions of said two adjacent flow paths and directing the radially-outwards gas flow at an increased inclination to a respective tangent to the coil core and also axially of the coil into the said annular space so as to direct the gas flow in the said helical path.

DESCRIPTION OF THE DRAWINGS

An annealing furnace loading system and furnace components therefor that are particular preferred embodiments of the invention will now be described, by way of example, with reference to the accompanying diagrammatic drawings, wherein.

DESCRIPTION OF THE PREFERRED EMBODIMENTS

Figure 1:
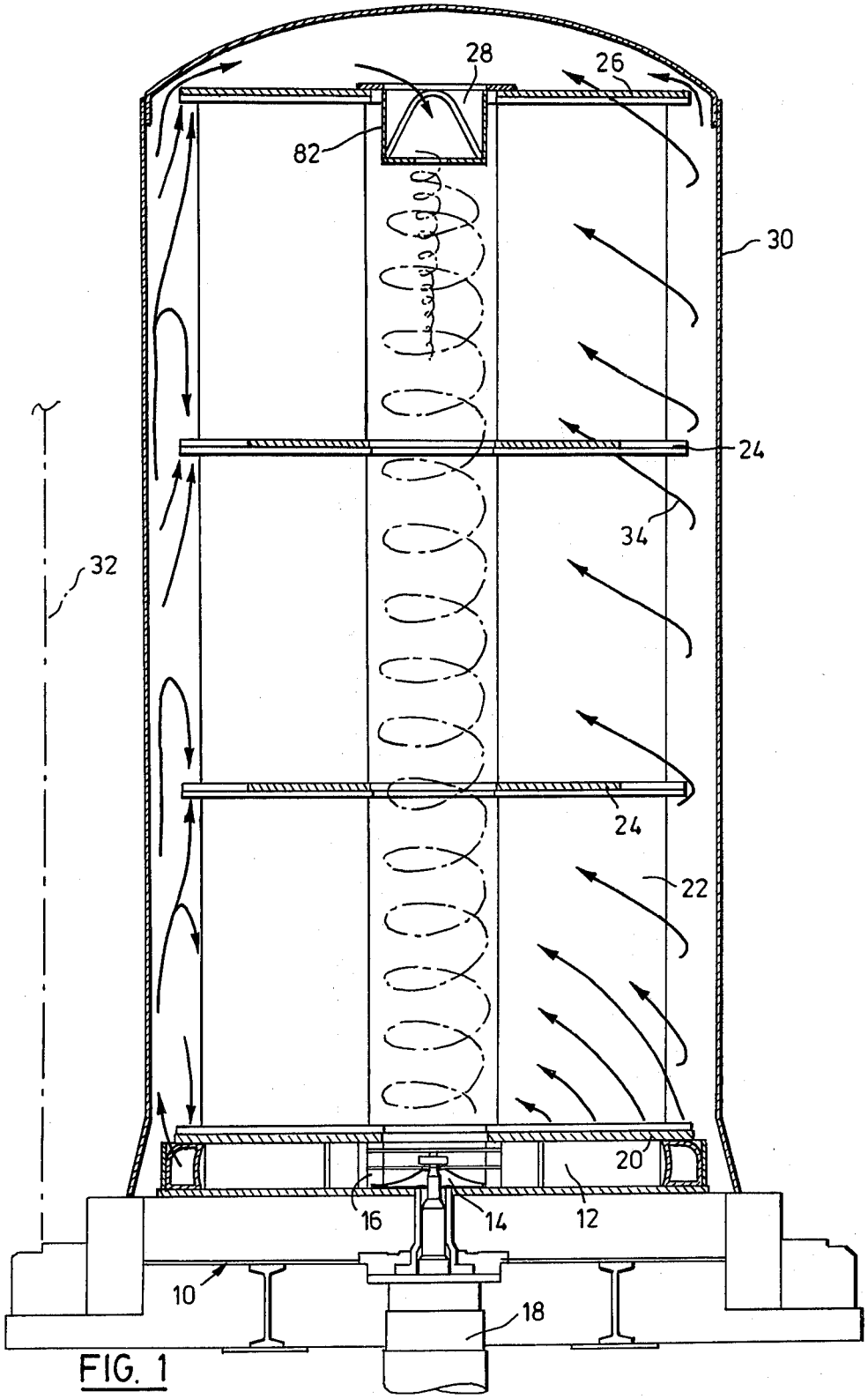
FIG. 1 is a longitudinal cross section through the furnace.

An annealing furnace in accordance with the invention consists of a base member indicated generally by the reference 10 mounted in a suitable pit in the ground. This base member supports on its upper surface a diffuser member 12 having a fan impeller 14 disposed in a central aperture 16 thereof, the impeller being driven by a motor 18. A charge plate 20 is mounted on the diffuser member, this charge plate also comprising a single convector plate portion to permit the circulating gas access to the lower end of a first coil 22 mounted thereon. A double convector plate 24 is mounted on the top of first coil 22 and a second coil 22 is mounted thereon, the double plate 24 permitting contact of the furnace atmosphere with the top and bottom ends of the first and second coils respectively. A second double convector plate 24 is mounted on the top of the second coil and a third coil is mounted thereon. A fourth coil can be mounted on the stack if there is room in the furnace; usually a furnace accommodates not more than four coils because of excessive loading of the lowest coil. A top plate 26 with a single convector portion mounted on the top of the third coil and has a flow plug member 28 mounted thereon. The resultant assembly is enclosed by a cylindrical bell-shaped inner muffle 30, which is in turn enclosed by a cylindrical, bell-shaped insulated outer cover 32.

The coils 22 are stacked coaxially with the axis of rotation of the impeller 14, and all of the convector plates and the diffuser member having central appertures that register with the bores of the coils. The impeller has a central inlet and is designed to suck gas axially at the required input angle for the desired swirling motion, as established by the apparatus, and to discharge it substantially tangentially and in order to provide the desired trajectory into the diffuser member, and the gas flow produced thereby is, as indicated by the arrows 34, tangentially outwards from the diffuser member but also upwardly and circumferentially of the inner cylindrical surface of the inner cover 30. The gas therefore moves in the annular passage between the inner wall of the muffle 30 and the outer surfaces of the coils in a controlled helical upward path with less dissipation of kinetic energy because of turbulence.

The upwardly-moving gas enters the different convector plates at their radially outer circumferences, passing therethrough in contact with the coil ends and returning to the fan impeller inlet via the coil bores. The gas that has not passed through the convector plates returns to the coil bores through the flow plug 28, the flow through the bores taking the form of a downwardly-moving, helical vortex that facilitates the heat exchange between the gas and the inside surfaces of the coils.

Figure 2:
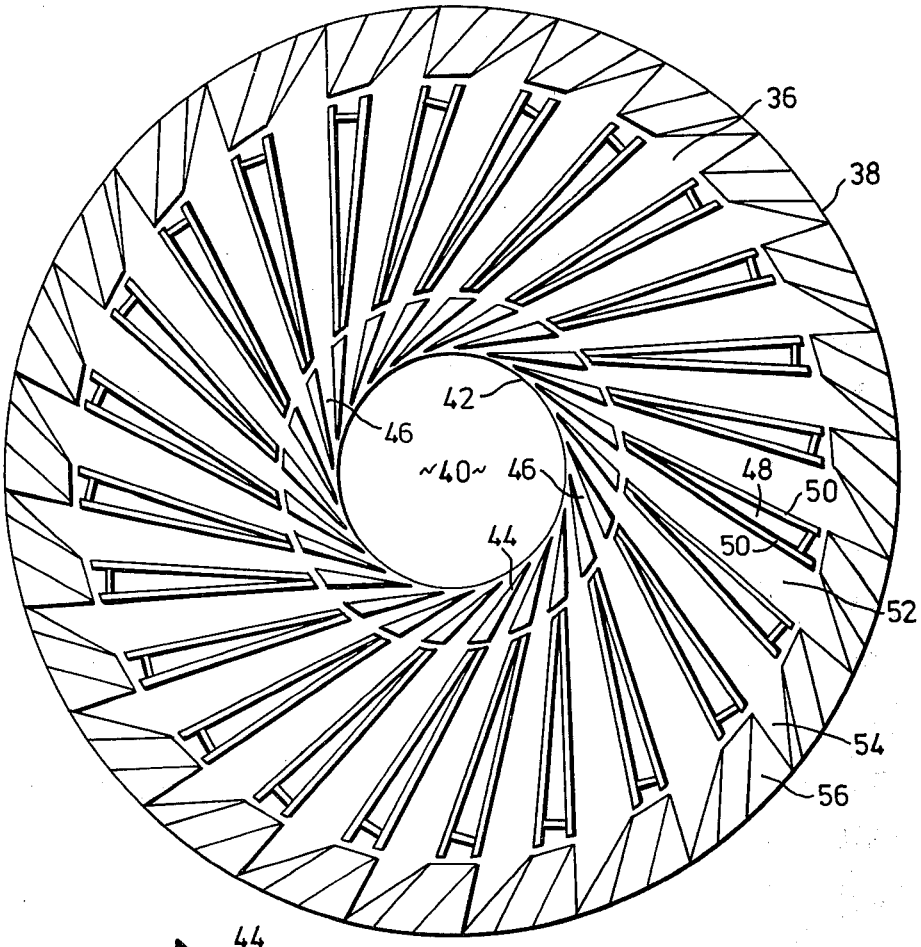
FIG. 2 is a plan view of a new diffuser member of the invention.
Figure 3:
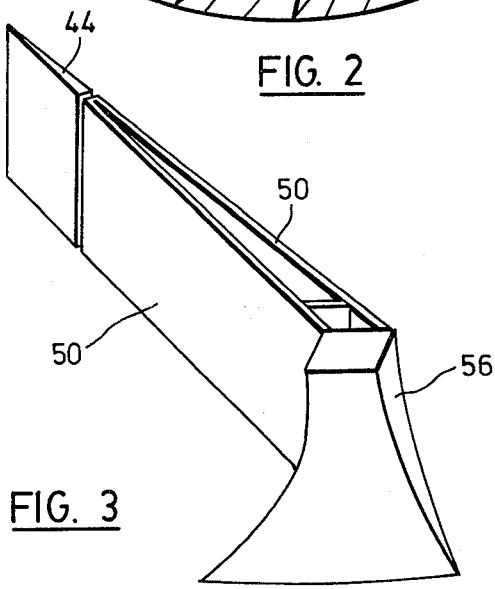
FIG. 3 is a perspective view of part only of the diffuser member of FIG. 2 to show in detail the construction of a diffuser assembly thereof.

The structure of the diffuser member 12 is more particularly shown in FIGS. 2 and 3 to which reference is now made. The member consists of a circular back plate 36 having a peripheral upstanding-rim 38 and a central aperture 40 therein for the passage of the shaft on which the impeller 14 is mounted. The impeller discharges radially and also circumferentially into a circle of rectangular entrances 42 formed by forward sharp edges 43 of uniformly-spaced outward-tapered diffuser elements 44, each adjacent pair of which form between themselves a corresponding outwardly-tapered radial/circumferential discharge passage 46 for the impelled gas. Each diffuser element is followed in the direction of the gas flow by a respective support element 48 consisting of two spaced diverging plates 50 upstanding from the base plate. The function of the support elements is to support the load on the diffuser member, namely the charge plate 20, the coils 22 and the convector plates 24, and accordingly they must be of very substantial construction to support this load, which normally will be about 25,000–50,000 Kg. Each adjacent pair of support elements 48 form between themselves a respective outwardly-tapered flow discharge passage 52 that is a smooth continuation of the passage 46 between the respective diffuser elements. The function of the diffuser elements is therefore to form entrances 42 for the gases having the desired orientation, the sharp edges 43 of which provide the minimum of obstruction to the gas flow. These thin wedge-shaped members are relatively delicate in construction and are made of a height such that none of the load is applied to them, this being taken solely by the support elements 48. The diffuser elements extend radially outwards for the minimum distance and until there is room to provide support members of the necessary thickness. Each flow passage 52 discharges into a flow guidance passage 54 formed between two adjacent flow guidance elements 56 which again are outwardly tapered, but which in addition are shaped to incline the respective flow passage at a greater angle to a radius, so that the gas flow is inclined at a greater angle, or in other words is made more circumferential. Moreover, the guidance elements in combination with the upstanding rim 38 change the direction of flow smoothly and less turbulently from radially outward to axially upward into the above-mentioned annular passage between the inner muffle and the coils. Thus, the flow guidance elements increase smoothly and progressively in width from about their mid height to their junctions with the base plate so that the passage is correspondingly shaped and the exiting gases are directed axially upward as well as circumferentially so as to direct them in the required flow. The gas is thereby directed in the desired smooth non-turbulent vortex inside the annular passage so as to obtain minimum turbulence energy losses while retaining good heat transfer from the heated muffle wall to the enclosed coils.

In this specific embodiment the diffuser element is 217 cm diameter with a back plate 36 that is 2.5 cm thick. The diffuser elements extend from a radius of 60 cm to a radius of 84.5 cm and are of height 17.15 cm, while the support elements extend from a radius of 85.7 cm to a radius of 181 cm and are of height 17.75 cm being formed of plates that are 2.5 cm thick. The rim 38 is 1.25 cm thick. Each flow plate formed by the passages and 54 is inclined at an angle of 30° outward from the respective tangent and the flow guidance elements in addition change the angle of the flow in the passage 54 by about 30° from the respective horizontal plane.

Figure 4:
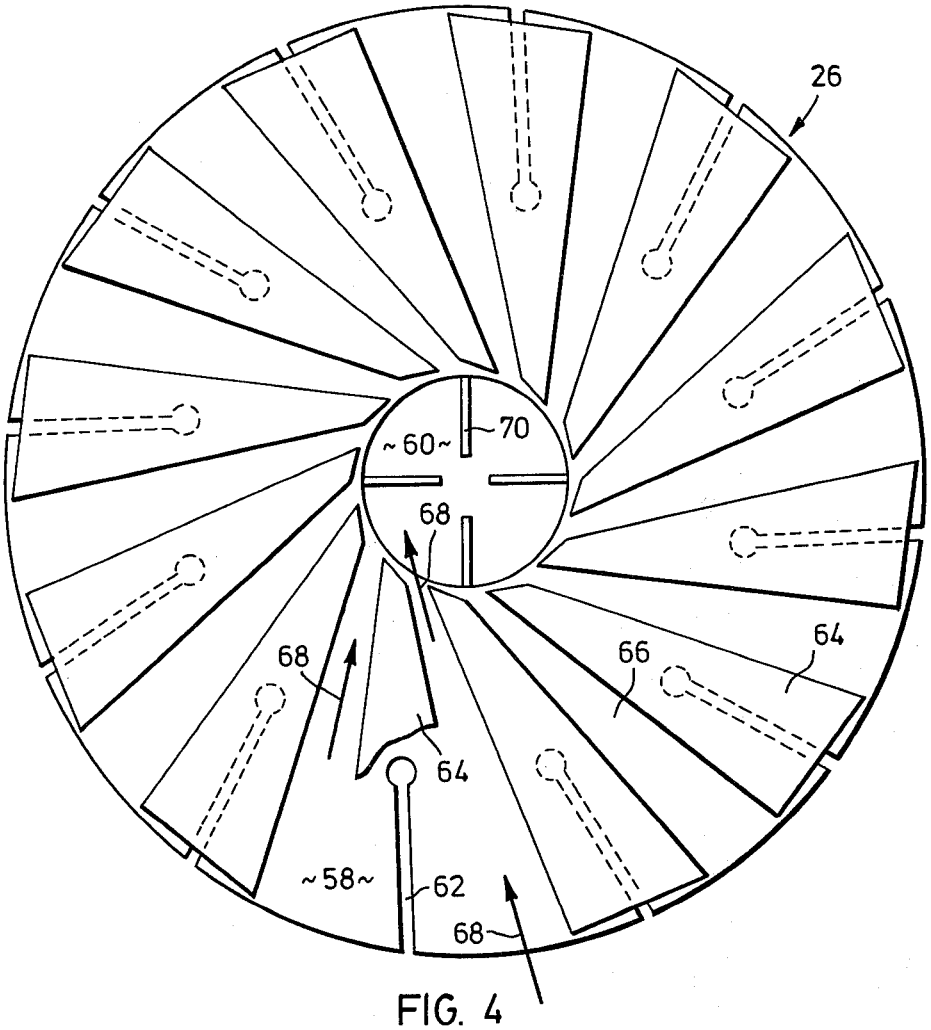
FIG. 4 is a plan view of a new charge plate of the invention.

The structure of the charge plate 20 is more particularly shown in FIG. 4 of the drawings. This consists of a flat circular back plate 58 having a central circular aperture 60 and provided around its edge with a uniformly-spaced plurality of circumferentially-expansion-relieving radial keyhole slots 62. A plurality of outwardly-tapered, spaced, wedge-shaped plate members 64 are welded to the top surface of the plate and provide support for the base of the lowest coil 22, the outwardly-tapered spaces 66 between each immediately-adjacent pair of members 64 constituting flow passages for the ambient gas that flows in the direction of arrows 68 radially inwards in contact with the edges of the adjacent coil base.

Since the gas flow in the passages 66 is radially inwards it would be preferred for the spaces to provide little restriction to the flow radially inwards but this would require the members 64 to be too thin at their radially innermost portions to support the load of the coils without distortion and the structure illustrated is the resultant compromise. Thus, twelve members 64 each subtend an angle of 30° at the centre, and are of inner radius 24 cm and outer radius 99 cm, each member having a circumferential width at its inner radius of 6.35 cm and at its outer radius of 30.5 cm, while the corresponding dimensions for the passages 66 are 6.35 cm and 20.3 cm.

It will be noted that the passages 66 are also inclined at the above-mentioned 30° angle to a tangent to the central aperture so as to maintain the desired swirling flow. The central aperture 60 is provided with four radially-inwardly protruding fingers 70 to catch any inner turns of the lowest coil that may unwind as a result of the annealing process and otherwise protrude through the aperture 60 and foul the impeller 14.

Figure 5:
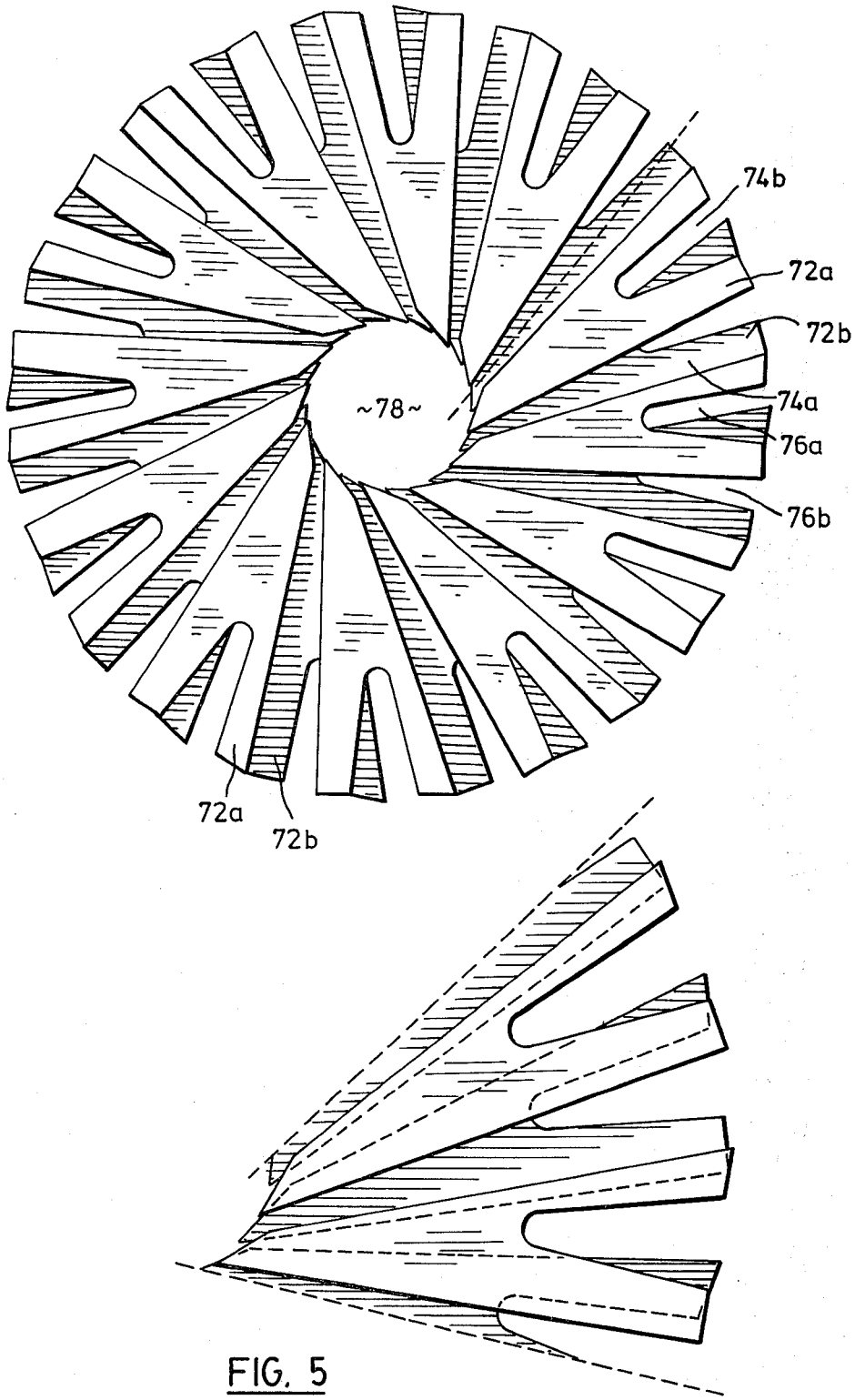
FIG. 5 is a plan view of a new double convector plate of the invention.

The structure of the new double-sided convector plate of the invention is particularly shown in FIG. 5 and its similarity with the charge plate 20 is apparent. Thus, the plate is assembled by welding together two separate pluralities of outwardly tapered circumferentially-spaced, wedge-shaped plate members 72*a* and 72*b* arranged in two separate layers. The spaced members 72*a* in the layer form corresponding radially-extending channels 74*a*, while the members 72*b* in the other layer form channels 74*b*, the members being staggered so that the members of one layer overlie the channels of the other layer, so that they can all be welded together into a unitary structure. Each member 72*a* or 72*b* has a respective radial slot 76*a* or 76*b* extending inwards from its outer circumference, these slots registering with the passages of the other layer to provide the maximum possible access to the respective passage for the inwardly flowing gas and so as not to impede the vertical gas flow. The channels or passages 74*a* and 74*b* are also inclined at the angle of 30° to a tangent to the respective central aperture 78. The radial and circumferential dimensions of the members 72*a* and 72*b* correspond to those of the members 64 of the charge plate. The radial slots 76*a* and 76*b* have an inner radius of 71.6 cm and an outer circumferential width of 18 cm.

Figure 6:
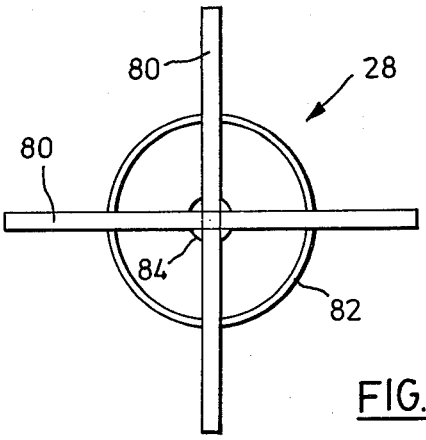
FIG. 6 is a plan view of a flow plug member for the furnace top plate.

The top plate 26 is of essentially the same structure as the charge plate in providing a single convector portion for the top end of the top coil backed by a solid circular annular plate. The flow plug member 28 is shown in plan view in FIG. 6 and fits within the central aperture of the top plate, being supported therein for example by cross bars 80 or by an annular rim (not shown). The body 82 of the flow plug member has the form of a cup which protrudes into the eye of the topmost coil, the bottom of the cup being provided with a central aperture 84 through which the remaining gas that has not passed through the convector plates must pass to return to the impeller inlet. It is found that the effect of this flow plug member is to ensure that the gas flow downwards through the stacked coils takes the form of a high energy swirling helix that scrubs against the inside turns of the coils, this helical flow being augmented by the various tangential radially inward flows from the various convector plates.

Figure 7:
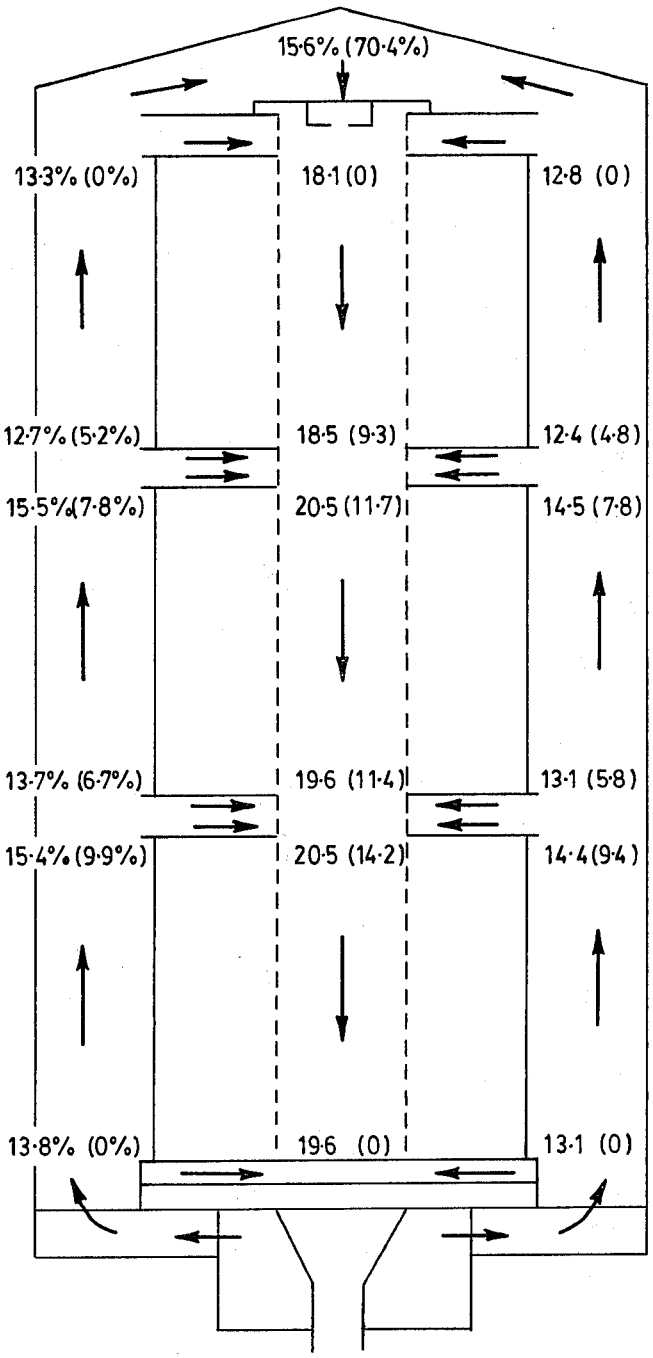
FIG. 7 is a schematic representation of an annealing furnace in longitudinal cross-section showing gas flow rates and heat transfer coefficients obtained with a prior art system and a system of the invention.

FIG. 7 is a schematic representation of an annealing furnace in longitudinal cross-section showing the measured full scale flow distribution of the circulating gas, and also the calculated heat transfer coefficients at the different convector plates, for a prior art arrangement and a system in accordance with the invention. These figures were calculated based upon tests conducted in a one quarter scale model of a full-size annealing furnace. The values for the prior art system are given in parentheses immediately after the corresponding figure for the system of the invention. The heat transfer coefficients (h) have been specified using the units $$h = \text{B.T.U./hr°F. ft.}^2$$

which are averaged over the entire top or bottom surface area and are evaluated at a temperature of 500° F. (260° C.), which is a suitable intermediate reference value for the usual range encountered in an annealing operation; the figures are given for the innermost and outermost diameters of each coil. It may be noted that the prior art system did not include a charge or top plate incorporating radial gas flow passages, the system relying instead upon transfer through the solid charge plate and direct contact with the gas at the top of the top coil, so that there are no corresponding figures for these parameters. Direct contact between the convective gases and the coil ends will provide better heat transfer than if the coil is in contact with a steel plate. This is due to the limited contact area and consequent high thermal resistance between a rough coil edge and a flat surface. The remarkable degree of aerodynamic uniformity achieved with the system of the invention will be apparent from the figures given, and in particular the uniformity achieved by use of the charge and upper plates and flow plug.

We claim:

1. A loading system for the charge of an annealing furnace of the kind employed for the treatment within a cylindrical inner muffle cover of a plurality of hollow-cored coils of metal products stacked in the muffle cover one on top of the other with the hollow cores thereof registered vertically with one another, and their outer cylindrical surfaces spaced from the inner cylindrical surface of the muffle cover to form an anular space between said cylindrical surfaces, the structure comprising:

a lowermost diffuser member adapted for support of the furnace charge, comprising a circular back plate member having at its centre an aperture for the reception of a gas impeller adapted to receive gas flowing axially from the registered hollow cores of the coils and discharge it radially through the diffuser member, the back plate having thereon a plurality of upstanding circumferentially spaced diffuser elements providing between themselves a corresponding plurality of radially-outwardly-extending gas flow passages from its centre to its periphery, the said passages conveying the impelled gas therethrough and discharging it radially and circumferentially into the annular space between the furnace muffle inner wall and the stacked furnace charge to move helically upward therein;

a lower load convector member for mounting on the diffuser member comprising a circular back plate member having thereon a plurality of upstanding, circumferentially-spaced plate members, said plate members receiving the lower end of the lowest coil, and providing between themselves a corresponding plurality of radially extending gas passages conveying impelled gas radially inward from said annular space to the impeller in heat exchange contact with the said coil lower end;

at least one intermediate convector plate member for mounting on the upper end of a coil and for receiving the lower end of a superimposed coil, comprising a plurality of connected circumferentially-spaced wedge-shaped members forming between themselves respective radially-extending gas passages conveying impelled gas radially inward from said annular space to the coil cores in heat exchange contact with the respective upper and lower coil ends;

an upper load convection member for mounting on the upper end of the uppermost coil, comprising a circular back plate member having thereon a plurality of downwardly-extending circumferentially-spaced diffuser elements providing between themselves a corresponding plurality of radially-extending gas passages conveying impelled gas radially inward from said annular space to the core of the uppermost coil in heat exchange contact with the upper end of the uppermost coil; and a flow plug member interposed in the path of the gas flowing from the said annular space into the uppermost coil core through the coil upper end, the flow plug member being mounted on the upper end of the uppermost coil so as to protrude downwards into the coil core and providing an opening to the uppermost coil core within the core restricting the flow of gas into the said uppermost coil core and facilitating the flow of gas through the vertically registered cores to follow a helical path in contact with the innermost turns of the coils.

2. A loading system as claimed in claim 1, wherein each of the said gas flow passages of the said members is inclined at an angle to a tangent to the respective coil core to maintain the helical gas flow in each component thereof.

3. A loading system as claimed in claim 2, wherein each gas flow passage is inclined at an angle of about 30° to a tangent to the respective coil core.

4. A loading system as claimed in claim 1 or 2, wherein the said lowermost diffuser member comprises a plurality of circumferentially spaced diffuser elements, each diffuser element comprising:

a radially inner diffuser element portion providing respective side wall portions of two adjacent flow path inlets and a sharp vertical forward edge at the radially inner intersection of said two side wall portions, each said radially inner element portion being of height less than the remainder of the respective element so that it is not engaged by the adjacent bottom edge of a coil mounted on the diffuser member;

a support element portion extending over a substantial radius of the diffuser member for engagement with the adjacent bottom edge of a coil mounted on the diffuser member to thereby support the furnace charge thereon and also providing respective side wall portions of the said two adjacent flow paths; and a radially-outer flow guidance element portion providing respective side wall portions of said two adjacent flow paths and directing the radially-outwards gas flow at an increased inclination to a respective tangent to the coil core and also axially of the coil into the said annular space so as to direct the gas flow in the said helical path.

5. A loading system as claimed in claim 1 or 2, wherein each said intermediate convector plate member comprises:

an upper plurality of circumferentially-spaced, wedge-shaped members disposed with their narrower ends radially inwards and forming between themselves a respective plurality of upper radially-extending gas flow paths meeting at a central aperture for heat exchange contact of the gas therein with the lower end of a superimposed coil resting thereon, and a lower plurality of like circumferentially-spaced, wedge-shaped members disposed with their narrower ends radially inwards and forming between themselves a respective plurality of lower radially-extending flow paths meeting at a central aperture registering with the first-mentioned central aperture for heat exchange contact of the gas therein with the upper end of a coil upon which the intermediate member rests;

the said upper plurality of wedge-shaped members being fastened to the said lower plurality of wedge-shaped members in register with the flow path spaces of the lower plurality and vice versa so as to form an integral self-supporting structure.

6. A loading system as claimed in claim 1 or 2, wherein each said intermediate convector plate member comprises:

an upper plurality of circumferentially-spaced, wedge-shaped members disposed with their narrower ends radially inwards and forming between themselves a respective plurality of upper radially-extending gas flow paths meeting at a central aperture for heat exchange contact of the gas therein with the lower end of a superimposed coil resting thereon, and a lower plurality of like circumferentially-spaced, wedge-shaped members disposed with their narrower ends radially inwards and forming between themselves a respective plurality of lower radially-extending flow paths meeting at a central aperture registering with the first-mentioned central aperture for heat exchange contact of the gas therein with the upper end of a coil upon which the intermediate member rests;

the said upper plurality of wedge-shaped members being fastened to the said lower plurality of wedge-shaped members in register with the flow path spaces of the lower plurality and vice versa so as to form an integral self-supporting structure, and wherein each wedge-shaped member has a radially-inwardly extending slot in its outermost edge connecting with the respective flow passage of the other plurality to permit vertical flow of gas between the two thus-connected passages.

7. A lowermost diffuser member for use in a loading system for the charge of an annealing furnace of the kind employed for the treatment within a cylindrical inner muffle cover of a plurality of hollow-cored coils of metal products stacked inside the muffle cover one on top of the other with the hollow cores thereof registered vertically with one another, the said diffuser member comprising:

a circular back plate having at its centre an aperture for the reception of a gas impeller adapted to receive gas flowing axially from the said registered hollow cores of the coils and discharge it radially through the diffuser member, the back plate having thereon a plurality of upstanding circumferentially-spaced diffuser elements providing between themselves a corresponding plurality of radially-outwardly extending gas flow passages from its centre to its periphery, the said passages conveying the impelled gas therethrough and discharging it radially and circumferentially into the annular space between the furnace muffle inner wall and the stacked furnace charge to move helically upward therein;

each said diffuser element comprising:

a radially inner diffuser element portion providing respective side wall portions of two adjacent flow path inlets and a sharp vertical forward edge at the radially inner intersection of the two said side wall portions, each radially inner element portion being of height less than the remainder of the respective element so that it is not engaged by the adjacent bottom edge of a coil mounted on the diffuser member;

a support element portion extending over a substantial radius of the diffuser member for engagement with the adjacent bottom edge of a coil mounted on the diffuser member to thereby support the furnace charge thereon and also providing respective side wall portions of the said two adjacent flow paths; and a radially-outer flow guidance element portion providing respective side wall portions of said two adjacent flow paths and directing the radially-outwards gas flow at an increased inclination to a respective tangent to the coil core and also axially of the coil into the said annular space so as to direct the gas flow in the said helical path.

* * * * *